US005269156A

United States Patent [19]

van de Velde et al.

[11] Patent Number: 5,269,156

[45] Date of Patent: Dec. 14, 1993

[54] METHOD AND APPARATUS FOR BACK BAR FREEZER UNIT

[75] Inventors: David H. van de Velde, 13200 Fiori La., Sebastopol, Calif. 95472; Anthony Y. Guido, San Francisco, Calif. 94133

[73] Assignee: David H. van de Velde, Sebastopol, Calif.

[21] Appl. No.: 942,668

[22] Filed: Sep. 9, 1992

[51] Int. Cl.[5] ..... F25D 3/08

[52] U.S. Cl. ..... 62/457.4; 62/371

[58] Field of Search ..... 62/457.4, 457.5, 457.2, 62/371, 530; 220/412

[56] References Cited

U.S. PATENT DOCUMENTS

| | | | |
|---|---|---|---|
| 103,955 | 6/1870 | Zeitz . | |
| 126,771 | 5/1872 | Avery et al. . | |
| 129,094 | 7/1872 | Briggs . | |
| 139,915 | 6/1873 | Piper . | |
| 181,950 | 9/1876 | Kromer . | |
| 241,142 | 5/1881 | Keech . | |
| 2,453,667 | 11/1948 | Lambert | 62/141 |
| 3,338,068 | 8/1967 | Piker | 62/457.4 |
| 3,365,911 | 1/1968 | Stoner et al. | 62/457.4 |
| 3,434,302 | 3/1969 | Stoner et al. | 62/457.4 |
| 3,933,275 | 1/1976 | Metzner et al. | 222/131 |
| 4,037,428 | 7/1977 | Giannotti | 62/371 |
| 4,531,381 | 7/1985 | Toro et al. | 62/372 |
| 4,809,522 | 3/1989 | de Neuers et al. | 62/457.4 |
| 4,842,350 | 6/1989 | Collings | 312/228 |

*Primary Examiner*—Albert J. Makay
*Assistant Examiner*—William C. Doerrler
*Attorney, Agent, or Firm*—Townsend and Townsend Khourie and Crew

[57] ABSTRACT

A rotationally molded transparent back bar freezer unit having an insulating double wall. A housing receives an inner compartment 30 made of a thermally-conductive material. A recess contoured to match a shape of a fluid container is formed in the inner compartment 30 and defines a second volume. A cooling material, such as ice and salt added to a first volume within the inner compartment 30 cools the fluid container in the second volume through the flexible wall. An access door facilitates presentation, loading and extracting of the fluid container into and from the recess that forms the cooling compartment.

26 Claims, 5 Drawing Sheets

METHOD AND APPARATUS FOR BACK BAR FREEZER UNIT

BACKGROUND OF THE INVENTION

The present invention relates generally to cooler units. More specifically, the present invention relates to a self-contained freezer unit for use on a back bar to chill spirits.

Fine distilled spirits are served at many social establishments including restaurants and lounges. These restaurants and lounges typically include an area having a bar at which customers consume beverages prepared for them by a bartender. The bartender prepares beverages from one or more combinations of spirits, water, ice and other flavorings and condiments. Often it is desirable that the spirits be chilled or "frozen" prior to serving. Chilling in the present context refers to reducing a temperature of a beverage to less than room temperature, about 50°-60° F., while freezing refers to a more significant reduction of temperature, i.e. about 20° F., or higher. Chilling a bottle of spirits in the bar environment is not a simple task, and freezing is even more difficult. The area behind the bar is filled with an array of bottles, glasses, and apparatus for preparation and serving of the beverages. A wide variety of products are available in the bar environment, including fine spirits, wine, beer and nonalcoholic beverages. In many ways these products compete with each other for selection by a patron. There are some storage areas, such as the back bar area, that provide patrons with a view of the beverage containers. There are other areas, such as below the bar, where the establishment keeps the more economical varieties of beverages. Also below the bar are sinks, miscellaneous storage areas and coolers. These coolers may either be ice containers or refrigerated units to chill the beverages. Refrigeration refers to those electromechanical devices employing a compressor and coolant, such as freon, to chill items. Such devices require electricity, are often bulky and most do not have a freezing capacity, and are therefore undesirable in many bar areas.

Many upscale restaurants that serve fine spirits provide an ambiance and tone for their bar and cater to their patrons in a effort to provide value-added services. These value-added services include an atmosphere of comfort, luxuriousness, and cleanliness. Freezers and ice chests for cooling beverages are preferably out the patrons' view. Thus, cooling beverages using these methods is done out of sight of the patron. An inability to use the back bar area for cooling not only makes a bartender's job more difficult, it also removes the beverage container from the back bar area where it may be viewed and selected by the establishment's customers. There is a tension between providing refrigeration for the beverage and keeping it in the view of patrons. Refrigeration space is limited, so beverages requiring refrigeration, such as beer and wine, are chilled in a below-bar refrigerator or icing-bin, leaving the spirits for display on a shelf without refrigeration.

One conventional way to chill spirits is to pass them directly over ice, thereby cooling them. This is undesirable for many beverages and especially for those fine spirits that have been repeatedly distilled. As the spirits cool, the ice melts, adding water back to the spirits. The added water dilutes the spirits and can impart an undesirable flavor.

Purveyors of distilled spirits are heavily regulated. It is impermissible for any establishment in the United States to serve spirits from a container that has a defaced label. Because cooling a container in contact with ice risks wetting the container's label, and subsequently subjecting the wet label to a greater risk of damage or removal, spirit containers are not typically cooled by surrounding them with ice. An alternate method of simply setting a spirit container on a bed of ice is also unsatisfactory. However, this method does not cool or freeze the spirits within the container to a degree acceptable to everyone, and it also risks wetting the label. Thus, the existing art continues to chill distilled spirits by shaking, stirring, or mixing the spirits in combination with ice. The melting ice undesirably dilutes and flavors the spirits. One reason that the chilling is inefficient is that contact area between a container and the ice is less than 100% due to the coarseness of the ice surrounding the container. An additional undesirable consequence of chilling containers by surrounding them in ice is that water created from the melting ice will drip from the container as the container is removed. Water dripping from the container as fluid is dispensed is unsightly and in some circumstances may be unsanitary.

There is an additional limitation for those distilled spirits distributors who desire to provide equipment, promotional items or gifts to those establishments that sell their spirits. The law limits the value of promotional items provided to any establishment. In California, the Alcoholic Beverage Control (ABC) limits the value of any one gift to $50, and a federal agency, the ATF (Alcohol, Tobacco and Firearms) limits the annual aggregate values of promotions or gifts to any single establishment to $150. Therefore, product promotion such as providing an establishment with such promotional items as neon signs or clocks must fall within these dollar limits.

SUMMARY OF THE INVENTION

The present invention includes apparatus and methods for simple, efficient and economical cooling units used for fluid containers such as bottles. The preferred embodiment of the cooling unit is a back bar freezer unit for use in lounge environments. The present invention improves upon prior art cooling systems as well as allowing production of low-cost, low-volume, aesthetically pleasing and functionally superior cooling units. These cooling units operate without electrical power, using cooling materials such as, for example, mixtures of ice and salt. The units are thus able to be positioned anywhere and used in sight of prospective and potential consumers of the cooled beverage.

According to one embodiment of the invention, it includes a housing enclosing a first volume, a base, a cover, a forward-tilting loading and extracting door, and an interior compartment, within the first volume, that encloses a second volume physically isolated but thermally coupled to the first volume. A fluid container, for example a bottle of fine distilled spirits, is placed in and extracted from the second volume by operating the door. The door includes a stop to limit opening of the forward-tilting door, allowing it to remain at a desired angle for displaying and holding the bottle. The bottom of the bottle remains within the cooling compartment when the bottle is loaded into the loading and extracting door. Since the fluid within the bottle also remains in the bottom of the bottle that is, in turn, within the cooling compartment, the cooling of the fluid is enhanced.

The preferred embodiment of the present invention provides a back bar freezer unit capable of freezing spirits in an upright position, maintaining the spirits' container virtually dry and drip-free, and through use of the front-loading, forward tilting door, allows easy access and dispensation of the spirits. Use of a iced brine water in contact with the inner compartment provides a 100% contact between the cooling medium and the container allows efficient cooling.

Other features and advantages of the present invention may be realized by reference to the remaining portions of the specification and drawings.

DESCRIPTION OF THE PREFERRED EMBODIMENTS

Figure 1:
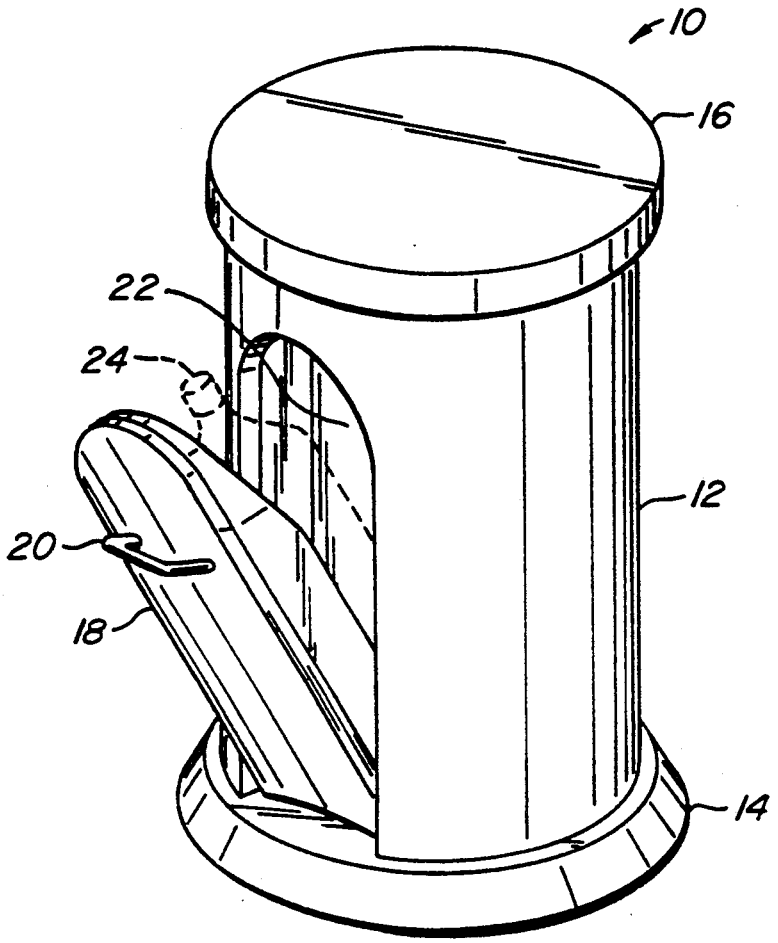
FIG. 1 is a perspective view of a preferred embodiment of a back bar freezer unit 10.

FIG. 1 is a perspective view of a preferred embodiment of a back bar freezer unit 10. The back bar freezer unit 10 includes an outer housing 12, a base 14, a cover 16 and an access door 18. The access door 18 includes a handle 20 to facilitate a user's opening it. The door 18 tilts forward to reveal a cooling compartment 22 within the housing 12. Items to be cooled are placed within the cooling compartment 22.

In the preferred embodiment, the back bar freezer unit 10 cools fluid containers, for example bottles of fine spirits, as shown by the bottle 24 drawn in phantom. The access door 18 includes a stop, described below, for limiting its opening to a maximum angle. The access door 18 functions both as a presenting mechanism and a loading and extracting mechanism for the bottle 24. The access door 18, tilted and held forward to the maximum angle, supports the bottle 24 placed thereon. Placing the access door 18 in an upright position loads the bottle 24 into the cooling compartment 22 for cooling it in an upright, vertical position. To access the bottle 24, the access door 18 is tilted forward, extracting the bottle 24 from within the cooling compartment 22. After a user tilts the access door 18 forward, the bottle 24 is presented for display and use.

One feature of the preferred embodiment is that the bottom (not shown) of the bottle 24 is held in the cooling compartment 22 even when the access door 18 is tilted forward. This helps to improve cooling of the fluid within the bottle 24. An additional feature is that the forward tilting of the access door 18 improves the cooling effect of the back bar freezer unit 10 by controlling and limiting handling of the bottle 24. One problem addressed by the forward tilting nature of the access door 18 is that handling of the bottle 24 to dispense the fluid from the bottle 24 heats it, counteracting the cooling effects of the present invention. Therefore, the handling of the bottle 24, in the first instance, is constrained to be from the top of the bottle 24, as its top is the only accessible part of the bottle. The top of the bottle 24 becomes progressively farther from the cooled fluid within the bottle 24 as the fluid is dispensed. The combined effects of the bottom of the bottle 24 being maintained in the cooling compartment 22, and the limited handling of the bottle 24 enhance the cooling action of the present invention because the heating time of the container, that is the time it is out of the cooling compartment, is reduced and handling of the container is better suited to maintain its cool temperature.

Figure 2:
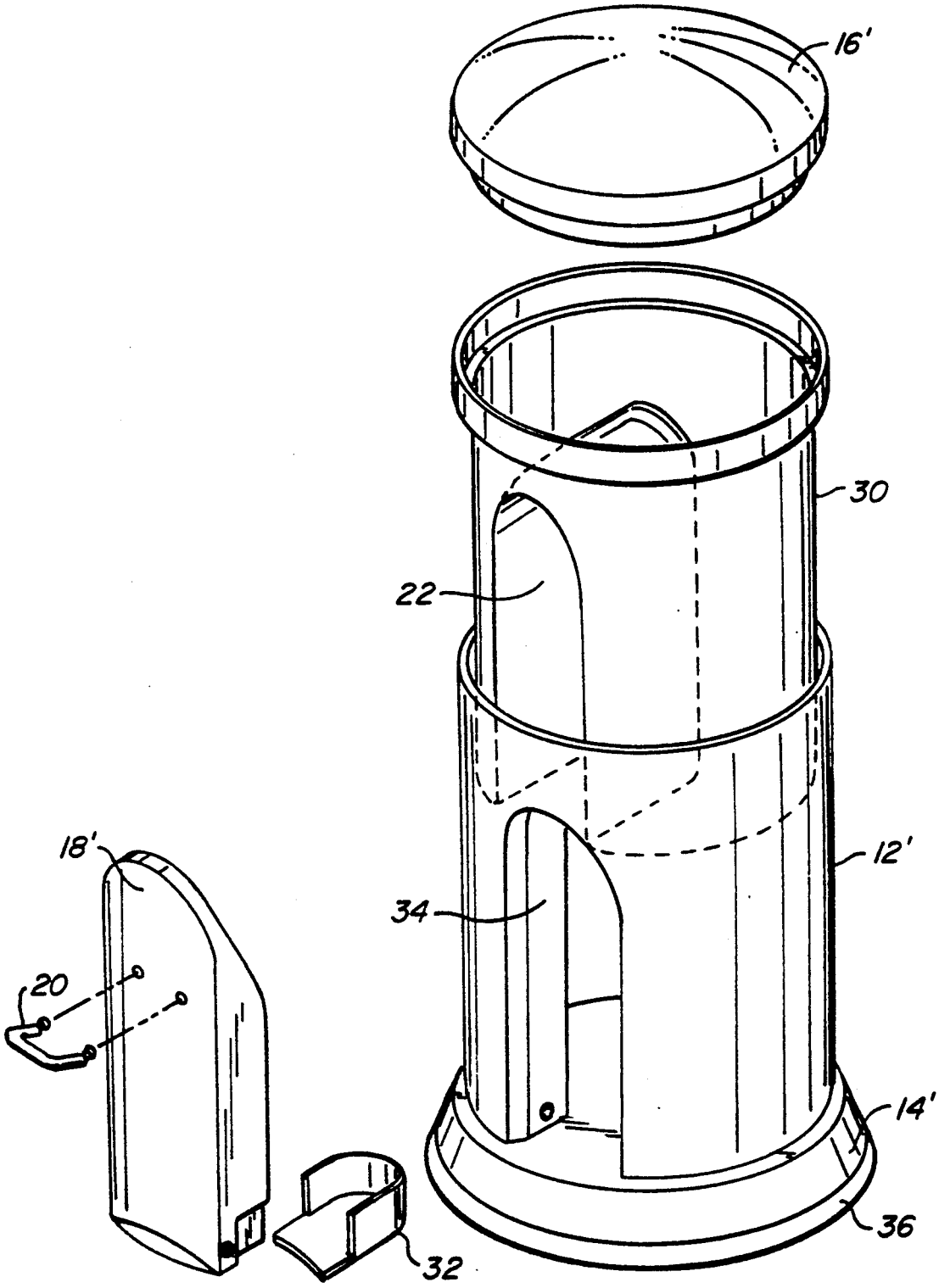
FIG. 2 is an exploded view of the back bar freezer unit 10 according to the preferred embodiment.

FIG. 2 is an exploded view of the back bar freezer unit 10 according to the preferred embodiment. In addition to the components identified in FIG. 1, the back bar freezer unit 10 includes an inner compartment 30 and a heel cap 32. The similarly numbered items of FIG. 2 that correspond to those of FIG. 1 identify the same structural elements. Differences relate to material types and properties making up the element.

One preferred use of the back bar freezer unit 10 is to promote use and sales of the fluid within the bottle 24 (FIG. 1). Rather than providing an opaque housing 12, which appeals to a potential user's curiosity and sense of adventure, an alternate embodiment of the present invention provides for use of transparent and semitransparent materials to allow a potential user to directly visualize the cold temperature of the fluid within the bottle 24. The transparent housing 12' and the transparent access door 18', together with the "frosted" base 14' and cover 16', combine to convince a prospective user that the fluid in the bottle 24 within the cooling compartment 22 is in fact quite cold.

The inner compartment 30 fits within the housing 12', creating a thermally-insulating outer wall for the freezer unit 10. The double-wall construction uses air as an insulator, but other thermally insulating gases or materials may be used, to assist in maintenance of a first volume, included within the inner compartment 30, at a reduced temperature. The inner compartment 30 includes a recessed portion, defining a part of the cooling compartment 22. The cooling compartment 22 defined in part by the recessed portion of the inner compartment 30 is accessed through an opening 34 in the housing 12'. The access door 18' is designed to provide a thermally-resistive seal with the housing 12' when the access door 18' is tilted into its closed position.

The inner compartment 30 is preferably made of thermally-conductive material, such as for example vinyl, and is flexible. The recessed portion of the inner compartment 30 is preferably shaped during manufacturing to match a contour of the bottle to be cooled within the cooling compartment 22. The flexibility of the inner compartment 30 allows the cooling compartment 22 to conform to the shape of the bottle, enhancing heat exchange between a cooling material within the first volume and the bottle within the second volume.

For some applications, it may be desirable to have the cooling compartment 22 adaptable to varying bottle shapes, rather than being customized for a single bottle shape as in the preferred embodiment. The recessed portion, in such a case, may be generically-shaped, but the flexibility of the inner compartment 30 facilitates conforming the cooling compartment 22 to the bottle's shape which in turn helps to maximize the cooling contact area while also contributing to maintaining a container within the inner compartment dry and drip-free. Additionally, the preferred embodiment allows the inner compartment 30 to be inserted and removed from the housing 12'. The cooling material may then be added to the inner compartment 30 in remote locations, out of sight of the patrons. Some users may prefer to add the cooling material on location however, and would not therefore require a removable inner compartment 30.

The heel cap 32 is an enhancement to the access door 18'. The heel cap 32 helps to extract a bottle loaded into the access door 18' when the door 18' is tilted forward. The heel cap 32 biases the bottle against the access door 18' so that tilting the access door 18' forward more reliably and securely extracts the bottle from the cooling compartment 22.

In the preferred embodiment, the inner compartment 30 is made transparent, like the housing 12'. The transparency of the housing 12' and the inner compartment 30 allows the bottle to be viewed when upright and loaded. The visual effect of observing the upright bottle in the back bar freezer unit 10, when surrounded by the cooling material, emphasizes the chilling effect of the freezer unit 10 and enhances the desirability of the chilled fluid within the bottle. To further the promotional aspects of the product, in addition to displaying the product while it is being chilled, the access door 18' includes a molded in logo or insignia. Additionally, the door 18' could be frosted to provide a visual impression of the freezing ability of the beverage within the unit 10. To further enhance the presentation and the appeal of the unit 10, the unit 10 is optionally equipped with a base 36. The base 36 includes a light source powered in a conventional fashion. Light from the light source passes up through the transparent and frosted elements of the freezer unit 10 to produce a striking effect.

In operation, the inner compartment 30 of the back bar freezer unit 10 is filled with the cooling material. As indicated above, the cooling material may be a salt and/or ice and/or water mixture, or ice only, depending upon the desired application. The inner compartment 30 is inserted into the housing 12' and the cover 16' placed over the top. The access door 18' is tilted forward to its stop and a bottle 24 (FIG. 1) is laid on top. When laying the bottle 24 on the access door 18', the base of the bottle is inserted into the heel cap 32. Thereafter, the access door 18' is tilted back to vertical, thereby inserting the bottle 24 into the cooling compartment 22. The door 18' thermally seals the bottle 24 within the cooling compartment 22 which conforms quite closely to the bottle's shape. The insulated outer wall of the housing 12' and the access door 18' help to limit melting of the ice and to improve the cooling time of the freezer unit 10. The cooling compartment 22, being in the recessed portion of the inner compartment 30, is thermally coupled to the cooling material through the thermally-transmissive inner compartment 30. The bottle 24, and hence its contents, are therefore cooled very effectively and efficiently. The flexible walls of the recessed portion of the inner compartment 30, which conform to the bottle's shape, help to prevent development of insulating layers of air between the bottle and the walls of the inner compartment 30, enhancing the cooling action.

When access to the chilled bottle 24 is desired, the access door 18' is tilted forward to its stop. The tilting of the access door 18' extracts the bottle 24 from the cooling compartment 22, due in part to the heel cap 32. The bottle 24, lying on the tilted access door 18' is thus presented for use. The user removes the bottle 24 from the access door 18' by gripping the bottle 24 at or near its top. While the bottle 24 is placed on the access door 18', the bottom portion of the bottle remains within the cooling compartment 22. The user is thus able to repeat the loading and extracting of the bottle into and out of the cooling compartment 22, as desired.

The preferred embodiment's use of the forward tilting access door 18' has a number of advantages. By being loaded from the front, as opposed to loading from the top as conventional type coolers, reduces a potential problem with label shaving. Additionally, containers are easily accessed to and from the unit 10 and may be used from limited areas having overlying shelving or cabinets.

Figure 3:
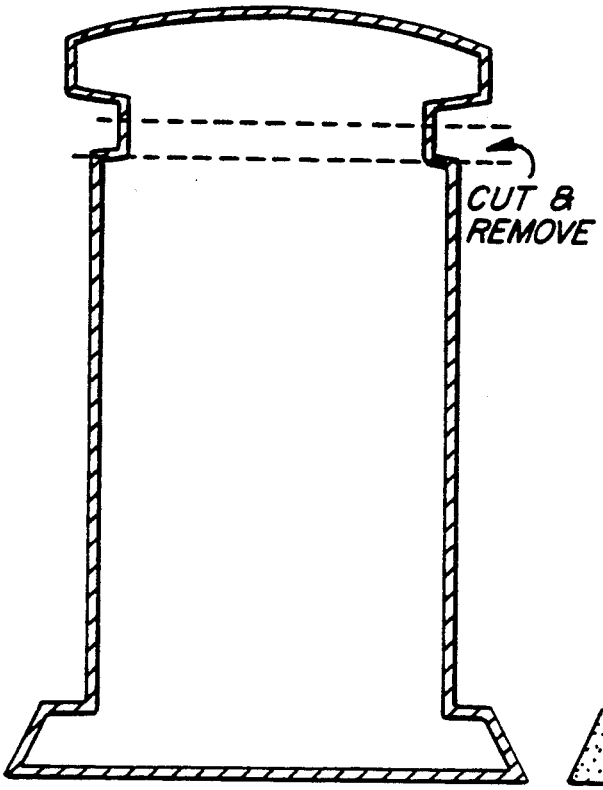
FIG. 3 is a sectional view of the back bar freezer unit 10 manufactured by a rotational molding technique.
Figure 4:
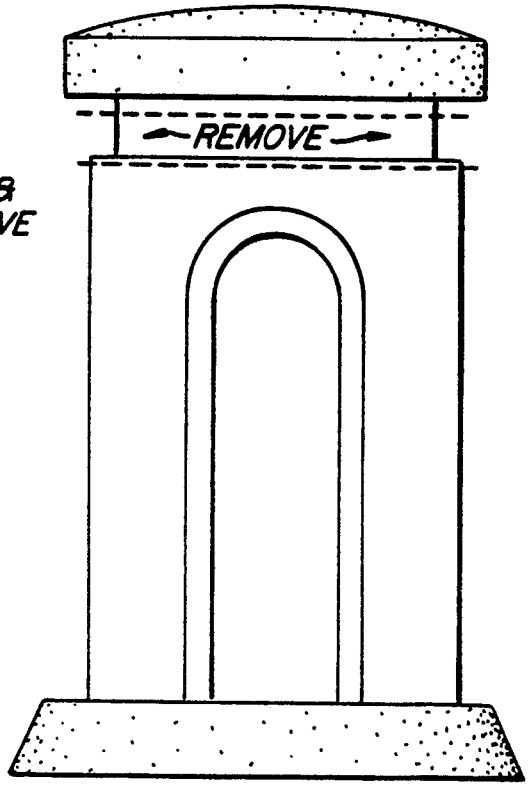
FIG. 4 is an exterior view of the back bar freezer unit 10.

FIG. 3 is a sectional view of the back bar freezer unit 10 manufactured by a rotational molding technique. One feature of the present invention is that its significant components are manufactured and assembled to allow very low-cost and low-volume production while still achieving the enhanced functionality disclosed herein. The preferred embodiment employs a conventional manufacturing technique known as rotational molding. In rotational molding, a liquid thermoplastic is added to an inside of a mold. The mold is rotated in three-dimensions to "coat" the inside of the mold. During the rotation of the mold, the thermoplastic gradually hardens and forms the desired object. Various types of thermoplastics are used in this process, including acrylic and vinyl, among others. The "frosting" of the components is achieved by texturing an inside portion of the mold that forms that region of the component. As shown in FIG. 3, the housing 12', base 14' and cover 16' are produced as one integral unit using rotational molding. Strategic shaping of the top portion of the main container produced from the mold, and appropriate cutting as illustrated, provides for a close-fitting cover 16' for the housing 12'. FIG. 4 is an exterior view of the back bar freezer unit 10. A portion of the housing 12' is also removed to form an opening for the access door 18' shown in FIG. 2. The base 14' and the cover 16' are heavily textured to appear frosted.

Figure 5A:
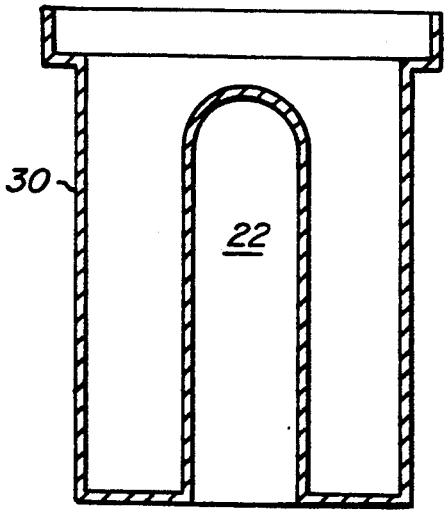
FIG. 5A is a front section view of the inner compartment 30 of the back bar freezer unit 10.

FIG. 5A is a front section view of the inner compartment 30 of the back bar freezer unit 10. The inner compartment 30 includes an open top. The inner compartment 30 of the preferred embodiment is rotationally molded using vinyl to form a flexible-walled container having a recessed portion. The recessed portion defines the cooling compartment 22. The inner compartment 30 contains a first volume inside and separates a second volume of the recessed space that defines a second volume with a thermally-conductive wall between the volumes. This construction provides the advantage of cooling the contents of the second volume by heat exchanges through the thermally-conductive wall without bringing the contents in the cooling compartment 22 into direct contact with the cooling material in the first volume. This is important for cooling bottles containing fine distilled spirits that also bear required labels identifying the bottle's contents. As noted above, the label cannot be defaced on a bottle to be served, therefore preventing the label from directly contacting the cooling medium reduces one problem with the prior art, namely reducing the risk to the label. Additionally, the prior art problem of water dripping from the containers.

Figure 5B:
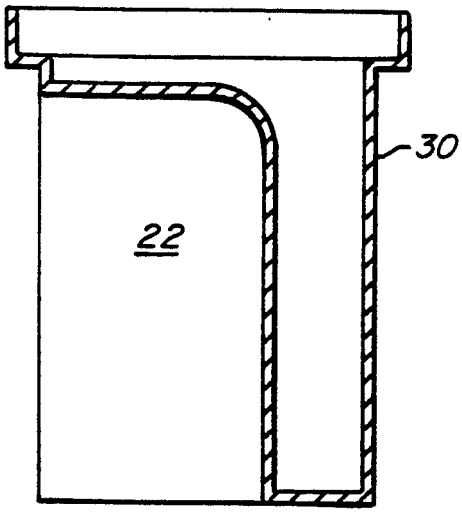
FIG. 5B is a side section view of the inner compartment 30 of the back bar freezer unit 10.

FIG. 5B is a side section view of the inner compartment 30 of the back bar freezer unit 10. The side section view further illustrates the separation of the cooling compartment 22 from the first volume defined inside the inner compartment 30.

Figure 6A:
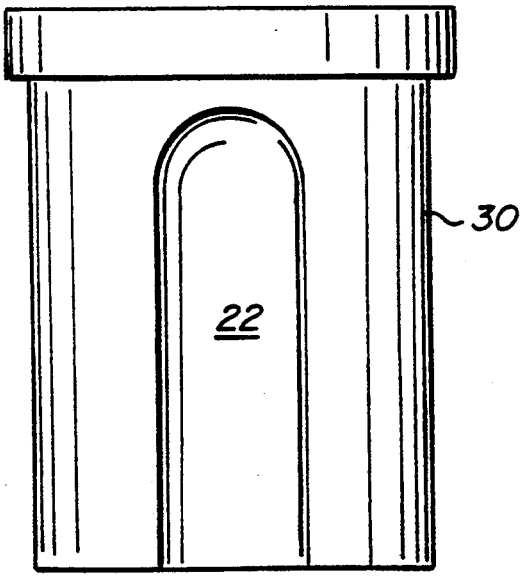
FIG. 6A is a front exterior view of the inner compartment 30 of the back bar freezer unit 10.

FIG. 6A is a front exterior view of the inner compartment 30 of the back bar freezer unit 10. The inner compartment 30 is preferably made of clear vinyl. The recessed region of the inner compartment 30 defines the cooling compartment 22.

Figure 6B:
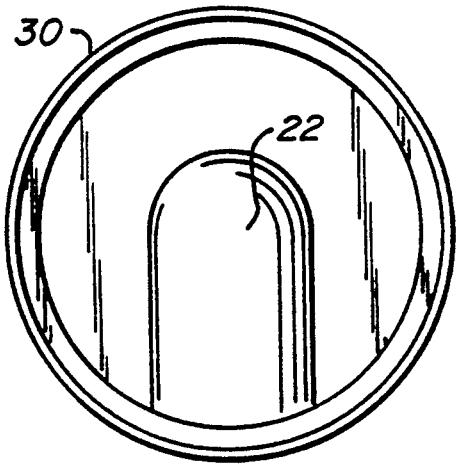
FIG. 6B is a top exterior view of the inner compartment 30 of the back bar freezer unit 10.

FIG. 6B is a top exterior view of the inner compartment 30 of the back bar freezer unit 10. The inner compartment 30 includes an inner volume for holding the cooling material. The inner volume is isolated from a second volume defined by a recessed portion of the inner compartment 30's exterior wall. Since the cooling material is preferably a salt and/or ice and/or water mixture, the integral formation of the inner compartment 30 by use of rotational molding provides a leak proof container.

Figure 7:
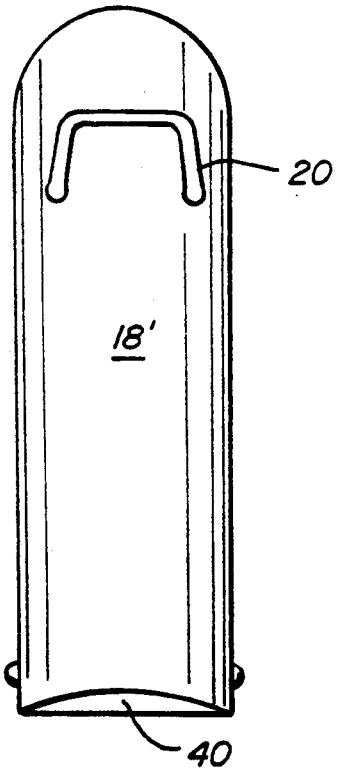
FIG. 7 is a front view of the access door 18' of the back bar freezer unit 10.

FIG. 7 is a front view of the access door 18' of the back bar freezer unit 10. The access door 18' is preferably rotationally molded of clear acrylic material. The handle 20 attaches to the access door 18' and facilitates tilting the door 18' forward. Integrated into a lower bottom edge of the access door 18' is a tilt stop 40. The stop 40 operates in conjunction with the base 14' to limit the forward tilt of the access door 18'.

Figure 8:
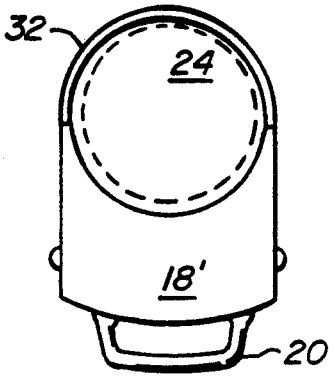
FIG. 8 is a top view of an upright, loaded access door 18' with the bottle 24 (shown in phantom) retained at its base by the heel cap 32.

FIG. 8 is a top view of an upright, loaded access door 18' with the bottle 24 (shown in phantom) retained at its base by the heel cap 32. The heel cap 32 helps to extract the bottle 24 from the cooling compartment 22 when the access door 18' is tilted forward.

Figure 9:
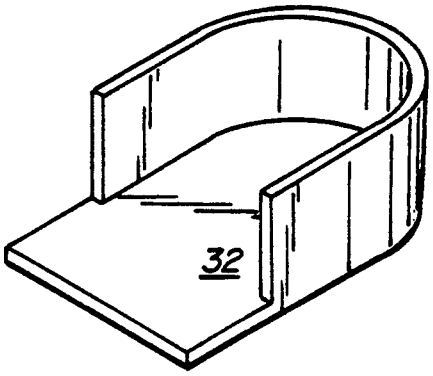
FIG. 9 is a view of the heel cap 32.
Figure 10:
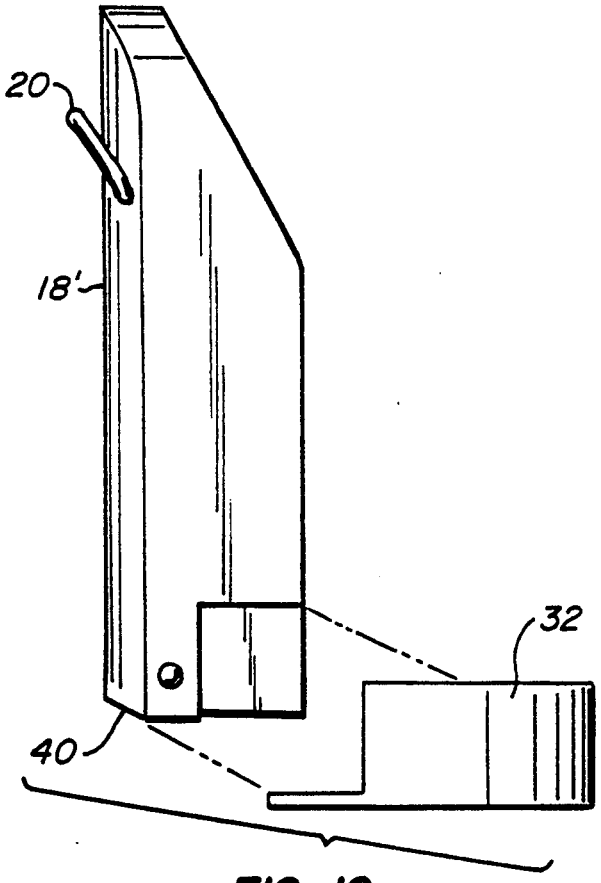
FIG. 10 is a side view of the access door 18' showing attachment of the heel cap 32.

FIG. 9 is a view of the heel cap 32. In the preferred embodiment, the heel cap 32 is vacuum-formed at low cost. FIG. 10 is a side view of the access door 18' showing attachment of the heel cap 32. The heel cap 32 is preferably solvent welded onto the access door 18' as shown.

Figure 11:
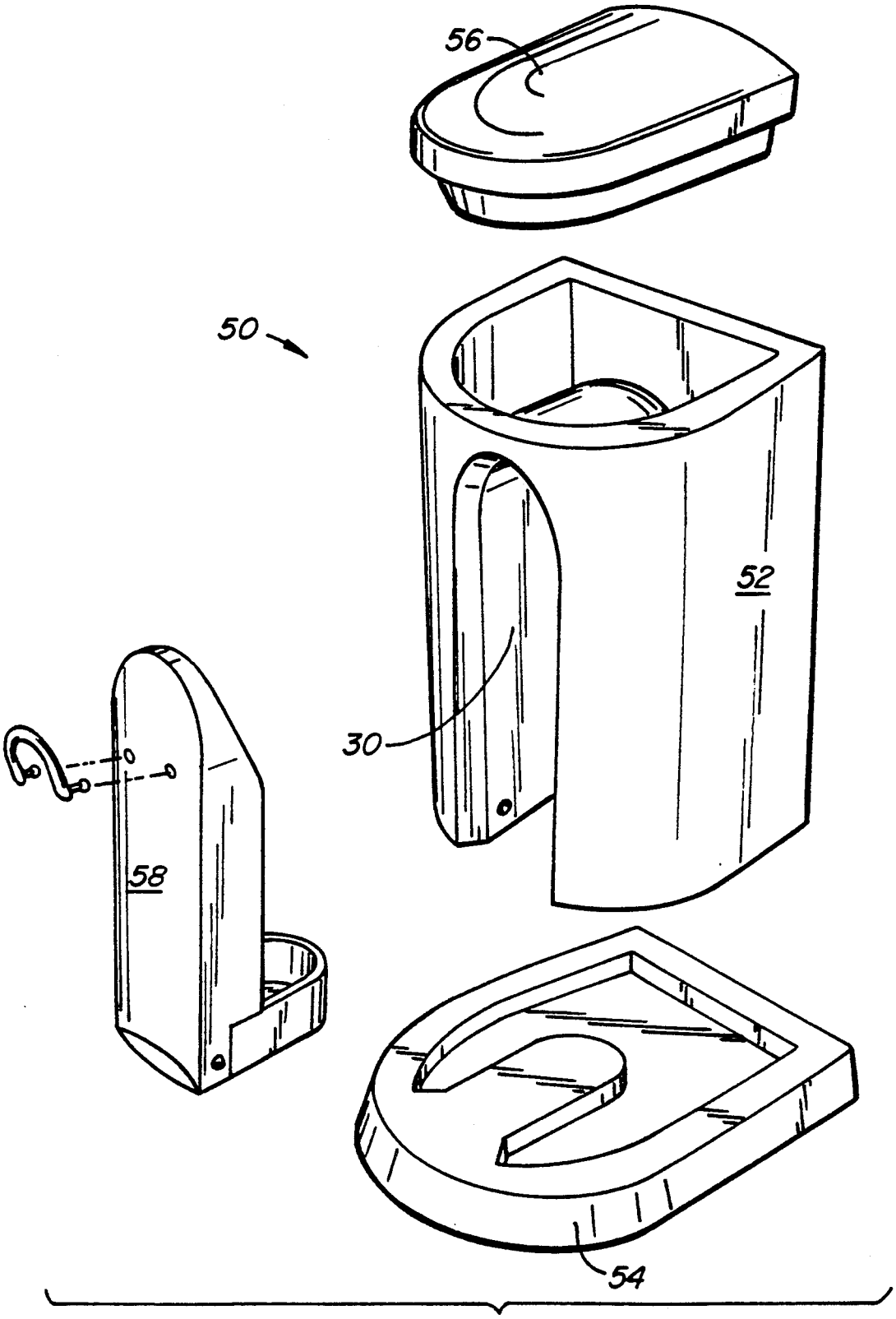
FIG. 11 is an exploded view of a preferred alternate embodiment of the present invention in a back bar freezer unit 50.

FIG. 11 is a exploded view of a preferred alternate embodiment of the present invention in a back bar freezer unit 50. The back bar freezer unit 50 shown is similar to the back bar freezer unit 10 shown in FIG. 1. A difference is that the back bar freezer unit 50 includes a double-walled housing 52, a base 54, a cover 56 and a door 58 made by different processes than those used for the corresponding components illustrated in FIG. 2, for example. The housing 52 is inexpensively formed by a heat draping operation. In conventional heat draping operations, a sheet of thermoplastic, such as acrylic, is placed over a male form and heated. When hot enough, the acrylic softens and takes the shape of the male form. Subsequent cooling of the sheet causes the thermoplastic to harden, retaining the shape of the male form. For the housing 52 shown in FIG. 11, a D-shaped piece formed from a heat draping operation is integrated with a flat sheet of acrylic to produce the finished shape. The two pieces of the housing 52 may be glued or solvent-welded together as well known in the art. Similarly, the inner compartment 30 is rotationally molded (as described above) and integrated with the housing 52 (for example, by gluing or solvent welding) to form the double-walled main unit. The base 54 and cover 56 may be either vacuum-formed or machined. The housing 52 may optionally be formed from acrylic tubes available commercially, and integrated with the inner compartment 30.

In conclusion, the present invention provides a simple, efficient solution to the problem of providing an attractive and efficient back bar freezer unit that overcomes some of the problems and limitations of the prior art. While the above is a complete description of the preferred embodiments of the invention, various alternatives, modifications, and equivalents may be used and will be apparent to those skilled in the art. Therefore, the above description should not be taken as limiting the scope of the invention, which is defined by the appended claims.

What is claimed is:

1. A freezer unit for cooling a fluid container, comprising:
   - a first housing having a top and containing a first volume for holding a cooling material;
   - a flexible, interior second housing containing a second volume, said first volume isolated from said second volume with said interior second housing thermally coupling said second volume to said first volume; and
   - a door coupled to said interior second housing through an opening in said first housing for accessing the fluid container from within said interior second housing when loading door is opened.

2. The freezer unit of claim 1 wherein said door includes an extracting mechanism for extracting the fluid container from within said interior second housing when said door is opened.

3. The freezer unit of claim 1 wherein said door includes an extracting mechanism for extracting the fluid container from within said interior second housing when said door is opened and said door is forward tilted.

4. The freezer unit of claim 1 wherein said first housing is upright.

5. The freezer unit of claim 1 wherein said interior second housing has a complementary shape to the fluid container.

6. The freezer unit of claim 1 wherein said interior second housing has a complementary shape to the fluid container and is conformable to match a shape of the fluid container.

7. The freezer unit of claim 1 wherein said first and second housing are transparent.

8. The freezer unit of claim 1 wherein said first and second housing are transparent and the freezer unit further comprises an illuminated base unit for transmitting illumination into said first and second housings.

9. A freezer unit for cooling a fluid container, comprising:
   - an insulated upright cylindrical housing having a removable top and containing a first volume for holding a cooling material;
   - a flexible, interior housing containing a second volume, said first volume isolated from said second volume with said interior housing thermally coupling said second volume to said first volume, said interior housing having a complementary shape to the fluid container; and a forward opening loading door coupled to said interior housing through an opening in said cylindrical housing for extracting the fluid container from within said interior housing when said loading door is tilted forward.

10. The freezer unit of claim 9 wherein said insulated housing is double walled.

11. The freezer unit of claim 9 wherein said insulated housing is transparent.

12. The freezer unit of claim 9 wherein said flexible housing is conformable to match a shape of the fluid container.

13. A method for cooling a fluid within a container, comprising the steps of:

placing the container within a freezer unit, said freezer unit comprising:

an insulated upright cylindrical housing having a removable top and containing a first volume for holding a cooling material;

a flexible, interior housing containing a second volume, said first volume isolated from said second volume with said interior housing thermally coupling said second volume to said first volume, said interior housing having a complementary shape to the fluid container; and a forward opening loading door coupled to said interior housing through an opening in said cylindrical housing for extracting the fluid container from within said interior housing when said loading door is tilted forward and inserting the fluid container into said interior housing when said loading door is tilted back;

adding said cooling material into said second volume; and inserting the fluid container into the inner housing by closing the door.

14. A freezer unit for cooling a fluid container, comprising:

a first housing having a top and containing a first volume for holding a cooling material;

a flexible, interior second housing containing a second volume, said first volume isolated from said second volume with said interior second housing thermally coupling said second volume to said first volume;

a door coupled to said interior second housing through an opening in said first housing for accessing the fluid container from within said interior second housing when said door is opened; and an extracting mechanism coupled to said door for extracting the fluid container from within said interior second housing when said door is opened.

15. The freezer unit of claim 14 wherein said door and extracting mechanism tilt forward for access to the fluid container within the interior second housing.

16. The freezer unit of claim 14 wherein said first housing is upright.

17. The freezer unit of claim 14 wherein said interior second housing has a complementary shape to the fluid container.

18. The freezer unit of claim 14 wherein said interior second housing has a complementary shape to the fluid container and is conformable to match a shape of the fluid container.

19. The freezer unit of claim 14 wherein said first and second housings are transparent.

20. The freezer unit of claim 14 wherein said first and second housings are transparent and the freezer unit further comprises an illuminated base unit for transmitting illumination into said first and second housings.

21. A freezer unit for cooling a fluid container, comprising:

a first housing having a top and containing a first volume for holding a cooling material;

a flexible, interior second housing containing a second volume, said first volume isolated from said second volume with said interior second housing thermally coupling said second volume to said first volume;

a door coupled to said interior second housing through an opening in said first housing for accessing the fluid container from within said interior second housing when said door is opened; and an extracting mechanism coupled to said door for extracting the fluid container from within said interior second housing when said door is opened and said door is forward tilted.

22. A freezer unit for cooling a fluid container, comprising:

a first transparent housing having a top and containing a first volume for holding a cooling material;

a flexible, interior second transparent housing containing a second volume, said first volume isolated from said second volume with said interior second housing thermally coupling said second volume to said first volume;

a door coupled to said interior second housing through an opening in said first housing for accessing the fluid container from within said interior second housing when said door is opened; and an illuminating base unit for transmitting illumination into said first and second housings.

23. An assembly for cooling a fluid container, comprising:

a first housing including, an outer wall, an inner, conformable wall, a first volume defined between said outer wall and said inner wall for holding a cooling material, a second volume defined by said inner wall, said second volume conformable to the fluid container, said second volume thermally coupled to said first volume through said inner wall, a first opening in said first volume coupled to a second opening in said second volume for accessing the fluid container within the second volume; and a second housing including, a wall defining a third volume, said third volume having a complementary shape to said first housing, a third opening in said second housing, said third opening aligning with the first and second openings.

24. The freezer unit of claim 23 wherein said third opening is sealable with a door.

25. The freezer unit of claim 23 wherein said third opening is sealable with a door, said door including an extracting mechanism for extracting the fluid container from within said second volume when said door is opened.

26. A freezer unit for cooling a bottle, comprising:

an outer cylindrical container having a top and a bottom and including, a base attached to said bottom of said outer cylindrical container, an insulated door hingeably attached to said outer cylindrical container for access to the inside of said container, a heel cap attached to said door, said heel cap sized to the outer dimensions of the bottle such that the bottle is held in place against said door;

a bucket having an outer wall and an inner wall including, a volume between said outer wall and said inner wall for holding a cooling material, said bucket dimensioned to fit within said outer cylindrical container, said inner wall of said bucket composed of flexible, conformable material sized to the outer dimensions of the bottle; and a lid, said lid sealing off the volume within the bucket.

* * * * *